US007971867B2

(12) United States Patent
Shiraiwa et al.

(10) Patent No.: US 7,971,867 B2
(45) Date of Patent: Jul. 5, 2011

(54) SHEET FEEDING APPARATUS AND MEDIUM DETECTING METHOD

(75) Inventors: Hiroshi Shiraiwa, Ishikawa (JP); Minoru Masuda, Ishikawa (JP); Ryoichi Yasukawa, Ishikawa (JP); Masaya Takamori, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 12/540,640

(22) Filed: Aug. 13, 2009

(65) Prior Publication Data

US 2010/0096799 A1 Apr. 22, 2010

(30) Foreign Application Priority Data

Oct. 17, 2008 (JP) ..... 2008-269146

(51) Int. Cl.
*B65H 5/00* (2006.01)
*B65H 7/02* (2006.01)

(52) U.S. Cl. ..... 271/10.01; 271/227

(58) Field of Classification Search ..... 271/227, 271/228, 10.01, 10.02, 10.03, 265.01–265.04, 271/262

See application file for complete search history.

(56) References Cited

U.S. PATENT DOCUMENTS

| | | | | |
|---|---|---|---|---|
| 4,602,778 | A * | 7/1986 | Hirose et al. | 271/227 |
| 4,941,377 | A * | 7/1990 | Ishihara et al. | 83/211 |
| 5,407,191 | A * | 4/1995 | Ukai | 271/227 |
| 5,988,634 | A * | 11/1999 | Elrick et al. | 271/265.04 |
| 6,089,563 | A * | 7/2000 | Takashimizu et al. | 271/117 |
| RE37,007 | E * | 1/2001 | Gerlier | 250/548 |
| 6,269,995 | B1 * | 8/2001 | Rich et al. | 226/17 |
| 6,375,180 | B1 * | 4/2002 | Kawano et al. | 270/58.09 |
| 6,641,134 | B1 * | 11/2003 | Dobbertin et al. | 271/226 |
| 7,270,326 | B2 * | 9/2007 | Mitsuya et al. | 271/265.04 |
| 7,419,156 | B2 * | 9/2008 | Mitsuya et al. | 271/262 |
| 7,427,061 | B2 * | 9/2008 | Ruthenberg et al. | 271/122 |
| 7,530,256 | B2 * | 5/2009 | deJong et al. | 73/1.37 |
| 7,537,212 | B2 * | 5/2009 | Mitsuya et al. | 271/258.02 |
| 7,588,245 | B2 * | 9/2009 | Mandel et al. | 271/122 |
| 7,722,026 | B2 * | 5/2010 | Hirate et al. | 271/10.02 |
| 7,896,342 | B2 * | 3/2011 | Tsukamoto et al. | 271/265.04 |
| 2002/0145249 | A1 * | 10/2002 | Acquaviva et al. | 271/228 |
| 2005/0263958 | A1 * | 12/2005 | Knierim et al. | 271/272 |
| 2006/0159470 | A1 * | 7/2006 | Yasukawa et al. | 399/21 |
| 2006/0250292 | A1 * | 11/2006 | Yamagata | 341/192 |
| 2008/0136092 | A1 * | 6/2008 | Elliot | 271/228 |
| 2008/0136094 | A1 * | 6/2008 | Elliot | 271/270 |
| 2008/0157465 | A1 * | 7/2008 | Matsumoto | 271/277 |
| 2008/0237975 | A1 * | 10/2008 | de Jong et al. | 271/228 |
| 2008/0265497 | A1 | 10/2008 | Kimura et al. | |
| 2009/0033027 | A1 * | 2/2009 | Sato | 271/228 |

FOREIGN PATENT DOCUMENTS

| | | | |
|---|---|---|---|
| JP | 2007-150909 | A | 6/2007 |
| JP | 2008-273691 | A | 11/2008 |

* cited by examiner

*Primary Examiner* — Kaitlin S Joerger
(74) *Attorney, Agent, or Firm* — Lowe, Hauptman, Ham & Berner, LLP

(57) ABSTRACT

A sheet feeding apparatus includes a feeding unit capable of feeding a sheet-like medium, plural speed detecting units capable of respectively detecting a speed of the medium fed by the feeding unit, at plural positions along a width direction of the medium orthogonal to a feeding direction of the medium, and a bound-medium detecting unit capable of detecting the medium having a part thereof bound with another one of the medium, based on the speed detected respectively by the speed detecting units.

6 Claims, 3 Drawing Sheets

SHEET FEEDING APPARATUS AND MEDIUM DETECTING METHOD

RELATED APPLICATIONS

The present application is based on, and claims priority from, Japan Application Number 2008-269146, filed Oct. 17, 2008, the disclosure of which is hereby incorporated by reference herein in its entirety.

BACKGROUND OF THE INVENTION

1. Field of the Invention

The present invention relates to a sheet feeding apparatus and a medium detecting method, and, more particularly to a sheet feeding apparatus and a medium detecting method that can be suitably applied to a sheet feeding apparatus capable of separating each sheet-like medium from plural sheet media and feeding each separated sheet-like medium.

2. Description of the Related Art

Conventional sheet feeding apparatuses are incorporated in an apparatus that handles paper sheets as plural-sheet media, such as an image reading apparatus like an image scanner, a copying machine, a facsimile machine, and a character recognition apparatus. The sheet feeding apparatus separates each sheet from stacked sheets, and feeds each separated sheet to the image reading apparatus. With this arrangement, even when plural sheets are stacked, each sheet can be automatically fed to the image reading apparatus, and the image reading apparatus fed with each sheet-like medium can process each sheet.

According to such a sheet feeding apparatus, when plural sheets are bound by a staple or the like, although a part of the sheets bound by the staple is fixed to other sheets, each sheet is fed and separated. Therefore, there is a risk that the sheets are rotated around a stapled portion, and the sheets and the apparatus are damaged. Consequently, according to the conventional sheet feeding apparatus, when a stapled original as a medium having plural sheets bound by a staple is detected, the sheet feeding apparatus stops feeding, thereby preventing the sheets and the apparatus from being damaged.

As a technique of detecting such a stapled original, for example, Japanese Patent Application Laid-open No. 2007-150909 discloses an original feeding apparatus that detects a stapled original from a result of detecting oscillation or acceleration of a contact member arranged contactably to an original being conveyed.

According to the above conventional sheet feeding apparatus, when a sheet is erroneously detected as a stapled original, feeding thereof is stopped, and there is a risk of decreasing the operation efficiency as a result. Accordingly, more accurate detection of a stapled original has been desired.

SUMMARY OF THE INVENTION

It is an object of the present invention to at least partially solve the problems in the conventional technology.

According to an aspect of the present invention, a sheet feeding apparatus includes a feeding unit that feeds a sheet-like medium; a plurality of speed detecting units that respectively detect a speed of the medium fed by the feeding unit, at a plurality of positions along a width direction of the medium orthogonal to a feeding direction of the medium; and a bound-medium detecting unit that detects the medium having a part thereof bound with another one of the medium, based on the speed detected respectively by the speed detecting units.

According to another aspect of the present invention, a medium detecting method includes detecting a speed of a sheet-like medium at a plurality of positions arranged along a width direction of the medium crossing a feeding direction of the fed medium; and detecting the medium having a part thereof bound with another one of the medium, based on the detected speed at the plurality of positions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a sheet feeding apparatus and a medium detecting method according to the present invention will be explained below in detail with reference to the accompanying drawings. The present invention is not limited to the embodiments. In addition, constituent elements in the embodiments include those that can be easily assumed by those skilled in the art or that are substantially equivalent.

Figure 1:
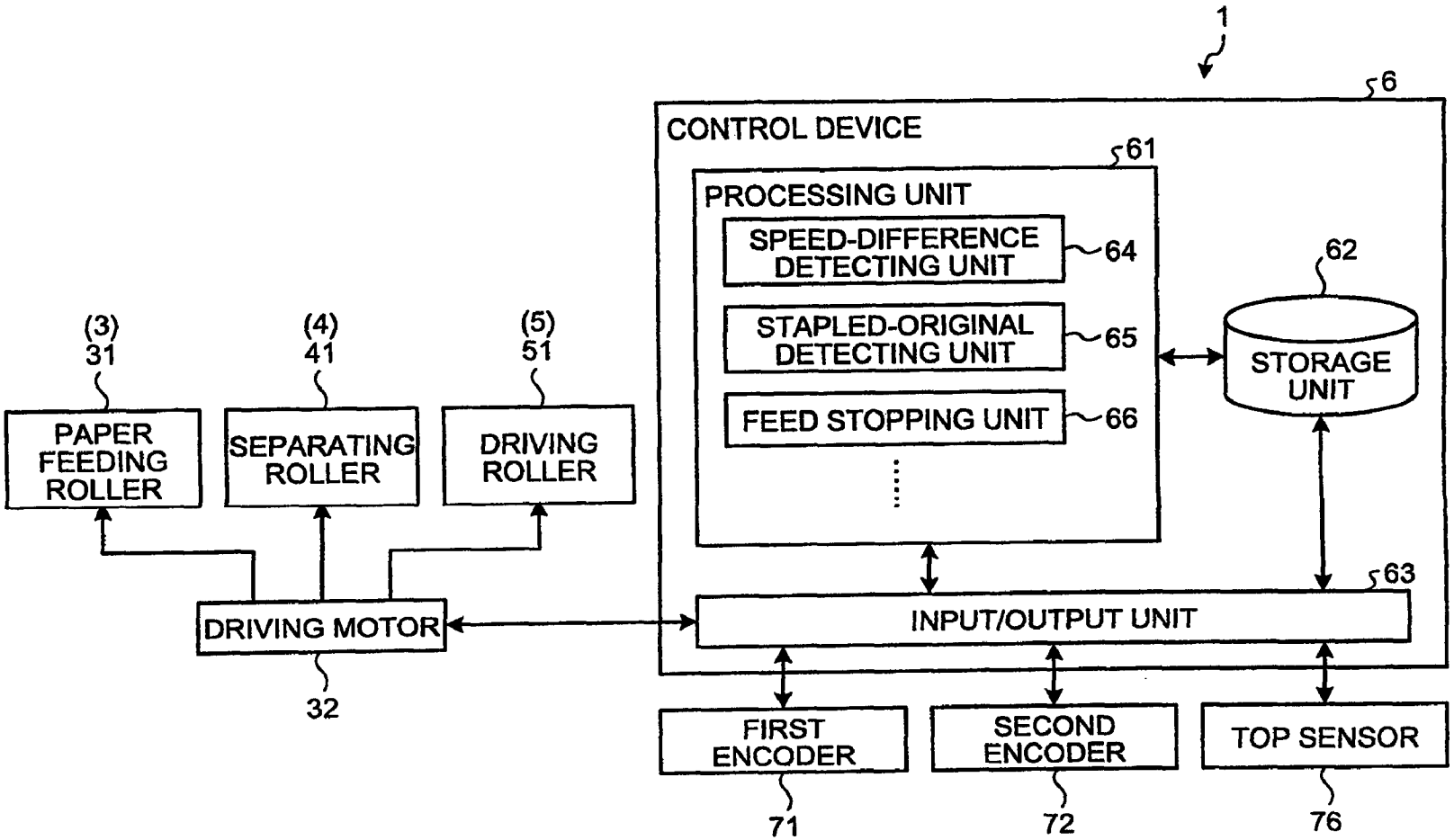
FIG. 1 is a schematic block diagram of a configuration of a sheet feeding apparatus according to an embodiment of the present invention.
Figure 2:
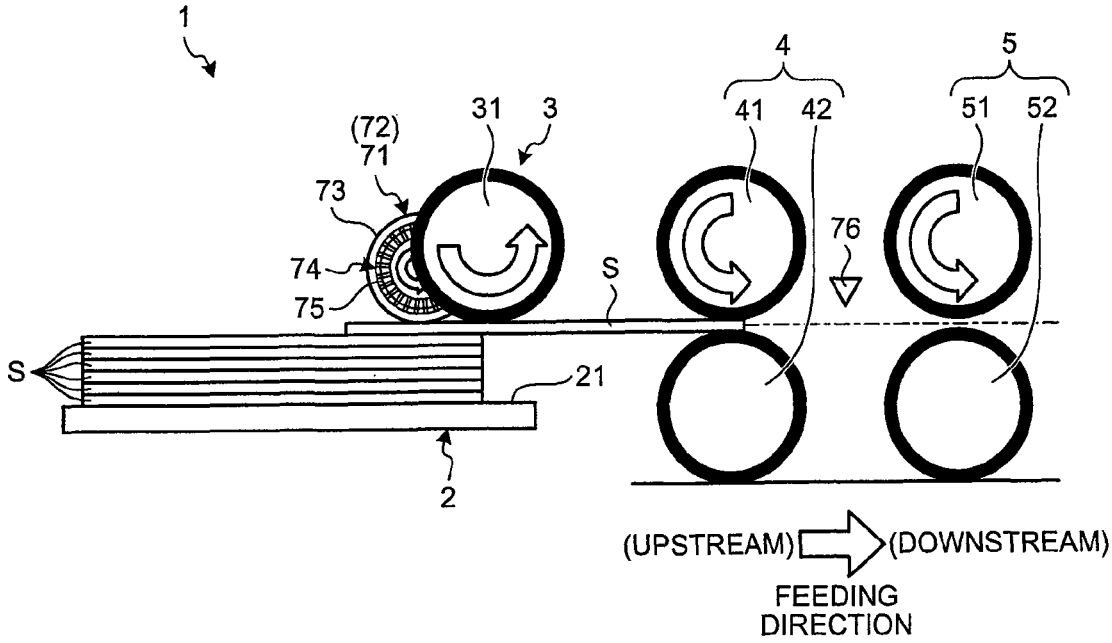
FIG. 2 is a schematic side view of the configuration of the sheet feeding apparatus according to the embodiment.
Figure 3:
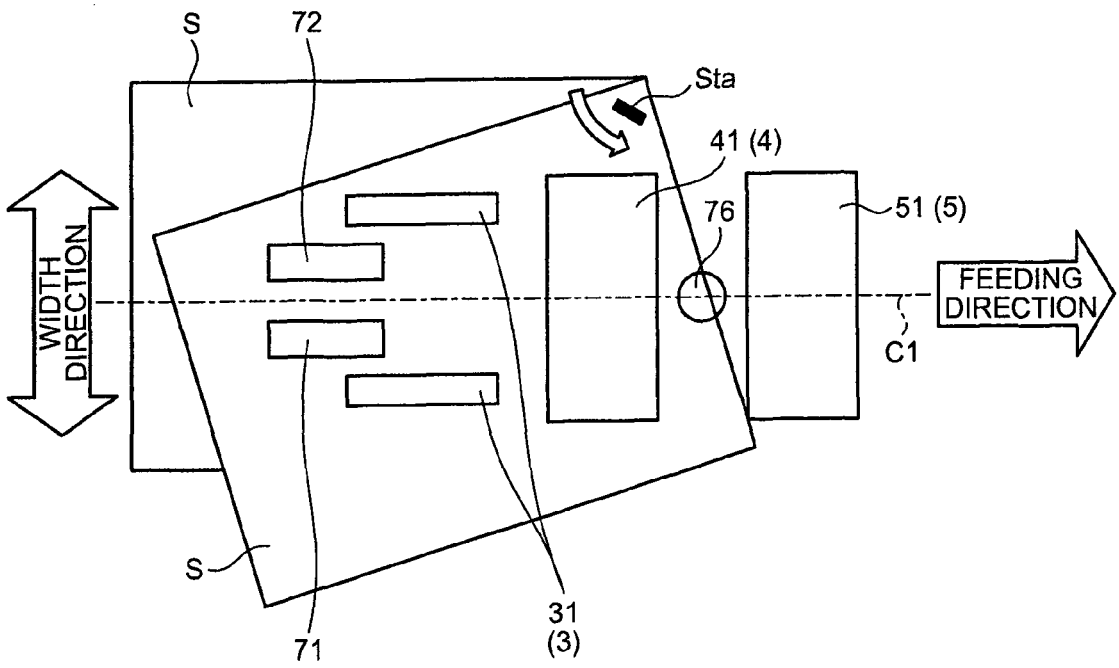
FIG. 3 is a schematic plan view of the sheet feeding apparatus according to the embodiment viewed from a paper feeding roller side.
Figure 4:
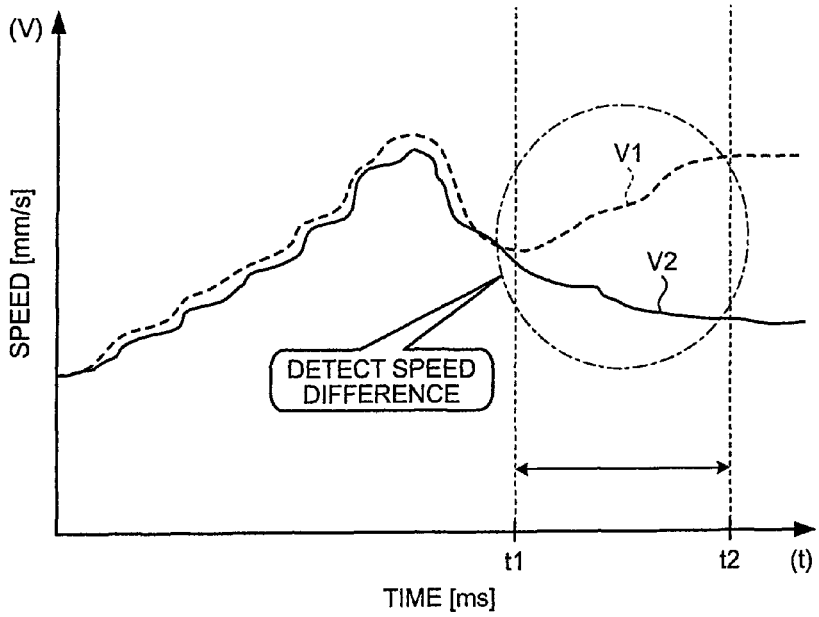
FIG. 4 is an example of a speed detected by an encoder of the sheet feeding apparatus according to the embodiment.
Figure 5:
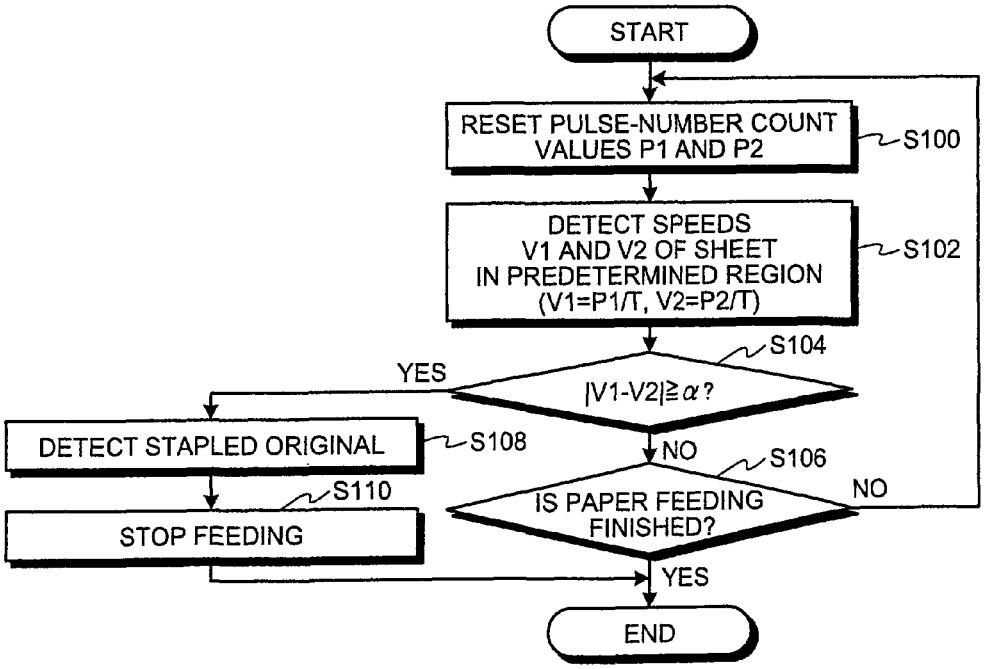
FIG. 5 is a flowchart of control including a stapled-original detecting method employed by the sheet feeding apparatus according to the embodiment.

FIG. 1 is a schematic block diagram of a configuration of a sheet feeding apparatus according to an embodiment of the present invention, FIG. 2 is a schematic side view of the configuration of the sheet feeding apparatus according to the present embodiment, FIG. 3 is a schematic plan view of the sheet feeding apparatus viewed from a paper feeding roller side, FIG. 4 is an example of a speed detected by an encoder of the sheet feeding apparatus according to the present embodiment, and FIG. 5 is a flowchart of control including a stapled-original detecting method employed by the sheet feeding apparatus according to the present embodiment.

The sheet feeding apparatus according to the present embodiment automatically feeds to a subsequent apparatus each sheet among sheets S as stacked sheet media, as depicted in FIGS. 1 to 3. A sheet feeding apparatus 1 according to the present embodiment is mounted on an image reading apparatus such as an image scanner, a copying machine, a facsimile machine, and a character recognition apparatus, as an apparatus that handles plural sheets S. The sheet feeding apparatus 1 separates each sheet from stacked sheets S, and feeds each separated one sheet to the image reading apparatus. However, the operation of the sheet feeding apparatus is not limited to this type, and it can also be applied to a sheet feeding apparatus that feeds cut sheets to a printing machine.

The sheet feeding apparatus 1 can automatically and continuously feed a large amount of plural sizes of sheets S to the image reading apparatus. The sheet feeding apparatus 1 according to the present embodiment can handle sheets S having plural types of sizes. That is, the sheet feeding apparatus 1 can automatically feed sheets S having plural types of sizes. As depicted in FIGS. 1 and 2, the sheet feeding apparatus 1 includes a hopper 2 as a mounting unit, a feeding unit 3, a separating unit 4, a carrying unit 5, and a control device 6.

In the following explanations, a direction in which the sheet feeding apparatus 1 feeds each sheet S is called "feeding direction", a direction orthogonal to the feeding direction and a thickness direction of the sheet S, respectively is called "width direction", and a thickness direction of the sheet S orthogonal to the feeding direction and the width direction, respectively is called "height direction".

The hopper 2 has stacked sheets S mounted thereon, and can rise and fall along the height direction (the thickness direction of sheets S). The hopper 2 has a mounting surface 21 formed in approximately a rectangular shape. The hopper 2 has plural sheets S stacked and mounted on the mounting surface 21. The stacked sheets S mounted on the hopper 2 are pressed against the mounting surface 21 by a bias force of a biasing unit (not depicted). The hopper 2 has a hopper lifting mechanism (not depicted), and the hopper lifting mechanism lifts and lowers along the height direction corresponding to a mounting amount of the sheets S mounted on the mounting surface 21.

The feeding unit 3, the separating unit 4, and the carrying unit 5 are provided with a predetermined distance along the feeding direction, and are positioned in the order of the feeding unit 3, the separating unit 4, and the carrying unit 5, from the upstream to the downstream of the feeding direction.

The feeding unit 3 is a so-called uptaking-system paper feeding mechanism, which feeds each sheet S mounted on the hopper 2, and has a paper feeding roller 31. The paper feeding roller 31 feeds a top-layer sheet S positioned at the top of sheets S mounted on the hopper 2, and is formed in a cylindrical shape by a material having a large frictional force such as foamed rubber, for example. The paper feeding roller 31 has its center axis set in substantially parallel with the width direction of the mounting surface 21, that is, in a direction orthogonal to the feeding direction of sheets S along the mounting surface 21. The paper feeding roller 31 has its center axis set on an upper surface side of the hopper 2 (a mounting surface 21 side), and has its external peripheral surface set at a position having a predetermined distance from the mounting surface 21 of the hopper 2 along the height direction. The sheets S are mounted on the mounting surface 21 so that a rear end (an upstream end in the feeding direction) of the sheets S is positioned at the upstream of the paper feeding roller 31 in the feeding direction. The hopper 2 comes close to the paper feeding roller 31 by rising along the height direction, and is separated from the paper feeding roller 31 by lowering.

Further, the paper feeding roller 31 is connected to a driving motor 32 as a driving unit via transmission gears and belts (both not depicted), and is rotated by a rotation driving force of the driving motor 32 by using the center axis as a rotation center. The paper feeding roller 31 is rotated in a picking direction, that is, a direction in which the external peripheral surface faces the separating unit 4 and the carrying unit 5 on the mounting surface 21 (a counterclockwise direction indicated by an arrow in FIG. 2).

The separating unit 4 separates each sheet from the sheets S fed from the hopper 2 by the feeding unit 3, and includes a separating roller 41, and a brake roller 42. The separating roller 41 is formed in a cylindrical shape by a material having a large frictional force such as foamed rubber, for example. The separating roller 41 is provided substantially in parallel with the paper feeding roller 31 at the downstream of the feeding direction of the paper feeding roller 31. That is, the separating roller 41 is set in a direction orthogonal to the feeding direction of the sheets S, with the center axis of the separating roller 41 set along the mounting surface 21. The separating roller 41 has its center axis set on an upper surface side of the hopper 2, and has its external peripheral surface set at a position with a predetermined distance from the mounting surface 21 of the hopper 2 along the height direction. This separating roller 41 is connected to the driving motor 32 via transmission gears and belts (both not depicted) to make the apparatus compact, and is rotated by the rotation driving force of the driving motor 32, with the center axis set as a rotation center. That is, the paper feeding roller 31 and the separating roller 41 share the driving motor 32 as a driving unit. Alternatively, a driving motor as a driving unit that rotates the separating roller 41 can be provided in a separate unit. The separating roller 41 is rotated in a direction in which the external peripheral surface faces the carrying unit 5 on the mounting surface 21 (a counterclockwise direction indicated by the arrow in FIG. 2.), in a similar manner to that of the paper feeding roller 31.

The brake roller 42 controls the feeding of sheets S other than sheets S that are directly in contact with the paper feeding roller 31. The brake roller 42 has substantially the same length as that of the separating roller 41, and is formed in a cylindrical shape. In a similar manner to that of the separating roller 41, the brake roller 42 is provided so that its center axis horizontally crosses the feeding direction of sheets S, that is, along the width direction of the sheets S. The brake roller 42 is rotatably provided, with its center axis set as a rotation axis line. The brake roller 42 is provided in facing contact with the separating roller 41 in the height direction at the mounting surface 21 side, and is pressed (biased) to the separating roller 41 side by a biasing unit (not depicted). An external peripheral surface of the brake roller 42 rotates to a direction of the carrying unit 5 on a surface where the external peripheral surface is in contact with the separating roller 41, following the rotation of the separating roller 41. The brake roller 42 can be configured to stop or separate sheets S fed from the top of a layer of sheets S by the feeding unit 3, by rotating the brake roller 42 to a direction opposite to a rotation direction of the separating roller 41, in place of the configuration that the brake roller 42 applies a bias force to the separating roller 41 side by a biasing unit (not depicted).

The carrying unit 5 is provided within the image reading apparatus where the sheet feeding apparatus 1 is mounted, and the carrying unit 5 feeds sheets S that are fed by the feeding unit 3 and passed through the separating unit 4 to each unit within the image reading apparatus. At the downstream of the carrying unit 5 in the feeding direction, an optical unit as an imaging unit that reads images of each sheet S is provided. Accordingly, this optical unit reads the images of each sheet S carried within the image reading apparatus by the carrying unit 5.

Specifically, the carrying unit 5 includes a rotatably-driven driving roller 51 (hereinafter, "the driving roller 51"), and a driven roller 52 rotatable following the driving roller 51. The driving roller 51 and the driven roller 52 have substantially the same lengths, and are formed in cylindrical shapes. The driving roller 51 and the driven roller 52 are provided so that their center axes cross horizontally the carrying direction of the sheets S, that is, along the width direction of the sheets S. The driving roller 51 and the driven roller 52 are rotatably provided, with their center axes set as rotation axis lines. The driven roller 52 is provided in face-to-face contact with the driving roller 51, and is pressed (biased) to the driving roller 51 side by a biasing unit (not depicted). At the time of carrying the sheets S, the external peripheral surface of the driving roller 51 is rotated in a direction from the separating unit 4 to the inside of the image reading apparatus on the surface where the external peripheral surface is in contact with the driven roller 52 (a counterclockwise direction in FIG. 2). At the same time, the external peripheral surface of the driven roller 52 is rotated in a direction from the separating unit 4 to the inside of the image reading apparatus on the surface where the external peripheral surface is in contact with the driving roller 51 following the rotation of the driving roller 51. The carrying unit 5 sandwiches each sheet S between the external peripheral surface of the driving roller 51 and the external peripheral surface of the driven roller 52 by the bias force of the driven roller 52. The carrying unit 5 carries each sheet S based on the rotation of the driving roller 51 as described above. The sheets S are sequentially delivered between plural driven rollers and plural rollers (both not depicted) provided along a carrying path, and are carried to each unit, such as the optical unit, for example, within the image reading apparatus.

The driving roller 51 is also connected to the driving motor 32 via transmission gears and belts (both not depicted) to make the apparatus compact. That is, the paper feeding roller 31, the separating roller 41, and the driving roller 51 share the driving motor 32 as a driving unit. However, the embodiment is not limited thereto, and a driving motor as a driving unit that rotates the driving roller 51 can be provided in a separate unit. The driving roller 51 is rotated at a faster rotation speed than those of the paper feeding roller 31 and the separating roller 41, based on an adjustment of the rotation speed by transmission gears and the like. That is, the carrying unit 5 can carry each sheet S separated by the separating unit 4, at a faster speed than that of the sheet S fed by the paper feeding unit 3. However, the carrying unit 5 is not limited thereto, and can be a unit that carries sheets S at a speed equivalent to that of sheets S fed by the paper feeding unit 3.

The control device 6 is configured to incorporate a microcomputer therein as a main component, and controls each unit of the sheet feeding apparatus 1. The control device 6 is electrically-connected to various types of sensors such as an emptiness sensor that detects presence of a sheet S of which rear end is positioned at the upstream of the separating roller 41, and a paper sensor that detects a mounting amount of sheets S mounted on the mounting surface 21, on the mounting surface 21, together with the driving motor 32. A photosensor using infrared rays or the like can be used for the emptiness sensor and the paper sensor. A detection result signal of the sheets S can be transmitted to the control device 6.

In the sheet feeding apparatus 1 having the above configuration, the paper feeding roller 31 of the feeding unit 3 is rotated in a pick direction (a counterclockwise direction indicated by the arrow in FIG. 2). With this arrangement, the paper feeding roller 31 receives, on its external peripheral surface, a top layer sheet S among sheets S mounted on the mounting surface 21 at the upstream of the paper feeding roller 31, and feeds the sheet to the separating unit 4 and the carrying unit 5 at the downstream of the feeding direction. At this time, when the paper feeding roller 31 feeds the top layer sheet S, sheets S other than the top layer sheet (for example, sheets S positioned below the top layer sheet) are sometimes directed from the paper feeding roller 31 to the separating roller 41 and the brake roller 42. In this case, sheets S that are brought together with the top layer sheet S are separated by the separating roller 41 and the brake roller 42 of the separating unit 4.

That is, a front end of the top layer sheet S is held between the separating roller 41 and the brake roller 42. Meanwhile, the sheets S that are brought together with the top layer sheet S are contacted by the brake roller 42, and the brake roller 42 controls the movement of these sheets S to the downstream of the feeding direction, and stops the brought sheets at the upstream of the brake roller 42. In this state, the sheet S of which front end is held between the separating roller 41 and the brake roller 42 is fed to the downstream along the rotation of the separating roller 41. Thereafter, front ends of the sheets S stopped at the upstream of the brake roller 42 are held between the separating roller 41 and the brake roller 42, and are fed to the downstream along the rotation of the separating roller 41. Accordingly, the separating unit 4 separates the sheets S that are brought together with the top layer sheet S by the separating roller 41 and the brake roller 42. As a result, only one top layer sheet S is fed to the carrying unit 5. The hopper 2 is sequentially lifted along the thickness direction corresponding to a mounted amount of the sheets S mounted on the mounting surface 21, and thus each top layer sheet S is fed to the carrying unit 5 from the sheets S on the mounting surface 21.

According to the above sheet feeding apparatus 1, there are following problems. For example, as depicted in FIG. 3, when plural sheets S are mistakenly stacked on the mounting surface 21 in a state that a corner of the sheets S are bound by a staple Sta or the like, each sheet S is fed and separated although these sheets S are bound by the staple Sta and a part of each sheet S is fixed to other ones. Consequently, there is a risk that the sheets S are rotated around the portion fixed by the staple Sta, and the sheets S and the sheet feeding apparatus 1 are damaged. Therefore, for example, when the sheet feeding apparatus 1 detects stapled sheets S bound by the staple Sta or the like, the sheet feeding apparatus 1 stops feeding of the sheets S, thereby preventing the sheets S and the sheet feeding apparatus 1 from being damaged.

Meanwhile, according to the sheet feeding apparatus 1 that stops-the feeding of sheets S upon detecting stapled originals, there is a risk of decreasing the operation efficiency by stopping the feeding of originals when the sheets are erroneously detected as stapled originals. Therefore, more accurate detection of stapled originals has been desired.

Thus, as depicted in FIGS. 1 to 3, according to the sheet feeding apparatus 1 of the present embodiment, a first encoder 71 and a second encoder 72 as plural speed detecting units detect the speed of sheets S fed by the feeding unit 3 at plural positions along the width direction, and a stapled-original detecting unit 65 as a bound-medium detecting unit detects stapled originals based on the speed of the sheets S at the plural positions. With this arrangement, the stapled-original detecting unit 65 detect rotation and deformation of a sheet S generated when the stapled originals are fed, based on the speed of the sheet S at plural positions, thereby accurately detecting the stapled originals. Based on the accurate detection of the stapled originals by the stapled-original detecting unit 65, the sheet feeding apparatus 1 can prevent the sheets S and the sheet feeding apparatus 1 from being damaged while suppressing the decrease of its operation efficiency.

In addition to the above configuration, the sheet feeding apparatus 1 according to the present embodiment includes the first encoder 71, the second encoder 72, and a top sensor 76 as plural speed detecting units.

A so-called rotary encoder is used for the first encoder 71 and the second encoder 72. That is, as depicted in FIG. 2, the first encoder 71 and the second encoder 72 have an encode disk 73, respectively as a rotating member formed in a disk shape. The encode disk 73 is provided with an encode pattern 74 on a side surface of the encode disk 73 along a peripheral direction. The encode pattern 74 is radially formed by plural slits 75 provided at a predetermined interval along the peripheral direction, on the side surface of the encode disk 73. Each encode disk 73 of the first encoder 71 and the second encoder 72 is provided at the upstream of the driving roller 51 of the carrying unit 5 in the feeding direction, in this case, at the upstream of the paper feeding roller 31 of the feeding unit 3. The encode disk 73 of the first encoder 71 is provided at the right side of the width direction of a center C1 of the width direction of sheets S properly mounted on the mounting surface 21, toward the downstream of the feeding direction as observed at the mounting surface 21. Meanwhile, the encode disk 73 of the second encoder 72 is provided at the left side of the width direction. The encode disk 73 of the first encoder 71 and the encode disk 73 of the second encoder 72 are arranged along the width direction orthogonal to the feeding direction of the sheets S, and are provided at mutually symmetrical positions along the width direction centered around the center C1 of the width direction.

FIG. 3 is a plan view of the sheet feeding apparatus 1 viewed from a side of the paper feeding roller 31. That is, FIG. 3 depicts the encode disk 73 of the first encoder 71 at the right side of the width direction toward the downstream of the feeding direction, and the encode disk 73 of the second encoder 72 at the left side of the width direction toward the downstream of the feeding direction. A pair of the paper feeding rollers 31 are provided at mutually symmetrical positions along the width direction centered around the center C1 of the width direction. The separating roller 41, the brake roller 42, the driving roller 51, and the driven roller 52 are provided on the center C1 of the width direction.

Center axes of the encode disks 73 are provided in substantially parallel with center axes of the paper feeding roller 31, the separating roller 41, and the driving roller 51. That is, each encode disk 73 is provided in a direction orthogonal to the feeding direction of sheets S, with the center axis of the encode disk 73 set along the mounting surface. The center axis of each of the encode disks 73 is set at the mounting surface 21 side of the hopper 2. Each of the encode disk 73 is rotatably provided, with its center axis set as a rotation axis line. Therefore, when the paper feeding roller 31 of the feeding unit 3 feeds sheets S toward the separating roller 41 of the separating unit 4, the external peripheral surface of each encode disk 73 is brought into contact with each sheet S, and is rotated in contact with each sheet S along the movement of each sheet S, thereby rotating in a counterclockwise direction in FIG. 2.

The first encoder 71 and the second encoder 72 further include a light emitting unit (not depicted) such as a light emitting diode, and a light receiving unit (not depicted) such as a photo transistor, at both sides of each encode disk 73. Accordingly, when light emitted by the light emitting unit passes through the slits 75 constituting the encode pattern 74, the light receiving unit can receive this light. On the other hand, when the light emitted by the light emitting unit is interrupted by a portion other than the slits 75 of the encode disk 73, the light receiving unit cannot receive this light. The light emitted by the light emitting unit passes through the slits 75 or is interrupted along the rotation of each encode disk 73. As a result, based on a fact that the light receiving unit receives or does not receive the light emitted by the light emitting unit along the rotation of each encode disk 73, that is, based on the encode pattern 74 formed by the plural slits 75, the first encoder 71 and the second encoder 72 can detect an electric pulse signal according to a rotational displacement or an angular speed of each encode disk 73.

Because each encode disk 73 of the first encoder 71 and the second encoder 72 rotates along a movement of each sheet S, the rotational displacement of each encode disk 73 at a rotation time corresponds to a moving amount of each sheet S. Therefore, by detecting the rotational displacement of each encode disk 73, a moving amount of each sheet S per unit time, that is, a speed of each sheet S, can be detected. Consequently, because each encode disk 73 of the first encoder 71 and the second encoder 72 is rotated in contact with each sheet S along the movement of each sheet S, the first encoder 71 and the second encoder 72 can detect the speed of each sheet S. The first encoder 71 and the second encoder 72 are electrically connected to the control device 6, and transmit a pulse signal corresponding to the rotation of each encode disk 73 to the control device 6 as an output.

Specifically, a pulse width of an output pulse waveform indicated by a pulse signal detected or generated by each of the first encoder 71 and the second encoder 72 appears as a shape inversely proportional to a moving speed of each sheet S relative to each encode disk 73. When a moving speed of each sheet S increases, that is, when a rotation speed of each encode disk 73 increases, a cycle of passing or interruption of light by the encode pattern 74 becomes short. Therefore, the pulse width of the output pulse waveform becomes small. When a rotation speed becomes lower, a cycle of passing or interruption of light becomes long, and a pulse width becomes large. In other words, a region in which a pulse width of an output pulse waveform indicated by a pulse signal detected or generated by each of the first encoder 71 and the second encoder 72 is small indicates that the speed of each sheet S becomes large, and a region in which a pulse width of the output pulse waveform is large indicates that the speed of each sheet S becomes small.

As described above, the encode disk 73 of the first encoder 71 is provided at the right side of the width direction of the center C1 in the width direction of sheets S properly mounted on the mounting surface 21, toward the downstream of the feeding direction as observed at the mounting surface 21. On the other hand, the encode disk 73 of the second encoder 72 is provided at the left side of the width direction. Therefore, the first encoder 71 detects a speed at the right side of the width direction of the center C1 in the width direction of sheets S toward the downstream of the feeding direction, and can transmit a pulse signal corresponding to this as an output to the control device 6. On the other hand, the second encoder 72 detects a speed at the left side of the width direction of the center C1 in the width direction of sheets S toward the downstream of the feeding direction, and can transmit a pulse signal corresponding to this as an output to the control device 6. More specifically, the encode disk 73 of the first encoder 71 and the encode disk 73 of the second encoder 72 are provided at mutually symmetrical positions along the width direction centered around the center C1 in the width direction. Therefore, the first encoder 71 and the second encoder 72 can detect the speed of each sheet S at symmetrical positions at both sides of the center C1 in the width direction of each sheet S.

Each encode disk 73 of the first encoder 71 and the second encoder 72 rotates in contact with each sheet S along the movement of the sheet S, and each of the first encoder 71 and the second encoder 72 detects a speed of each sheet S based on the encode pattern 74 provided on the encode disk 73. Because each sheet S moves to the feeding direction relative to each encode disk 73, each of the first encoder 71 and the second encoder 72 can detect a speed of each sheet S in the entire region of each sheet along the feeding direction.

The first encoder 71 and the second encoder 72 are preferably provided within a feeding region of a minimum-sized sheet S that can be fed by the feeding unit 3. That is, preferably, each encode disk 73 of the first encoder 71 and the second encoder 72 is provided within a region corresponding to a minimum-sized sheet S so that each encoder can detect speeds at both ends of the width direction of at least a sheet S having a minimum length in the width direction among various sizes of sheets S that can be fed by the feeding unit 3. With this arrangement, even when a minimum-sized sheet S that can be fed by the sheet feeding apparatus 1 is used, both the first encoder 71 and the second encoder 72 can detect the speed of the sheet S.

The top sensor 76 is provided between the separating roller 41 of the separating unit 4 and the driving roller 51 of the carrying unit 5, and detects presence of a sheet S at the downstream of the separating unit 4 and at the upstream of the carrying unit 5 in the feeding direction. The top sensor 76 can transmit a result of detecting a sheet S to the control device 6. In the present embodiment, while a photo sensor using infrared rays or the like can be used for the top sensor 76, the top sensor 76 can be arranged to detect presence of the sheet S by using an ultrasonic wave or the like.

The control device 6 of the sheet feeding apparatus 1 is a computer such as a personal computer, and includes a processing unit 61, a storage unit 62, and an input/output unit 63 as depicted in FIG. 1. The processing unit 61 and the storage unit 62 are connected to each other. Further, in the control device 6, the processing unit 61 is connected to the driving motor 32, the top sensor 76, the first encoder 71, the second encoder 72, and other various types of sensors via the input/output unit 63.

The storage unit 62 stores a computer software program that executes various types of control including the stapled-original detecting method as the medium detecting method according to the present invention. The storage unit 62 can be configured by a hard disk apparatus, a magneto-optical disk apparatus, a nonvolatile memory such as a flash memory (a recording medium that can only read such as a compact-disk read only memory (CD-ROM)), and a volatile memory such as a random access memory (RAM), or by combinations thereof.

The computer software program can be a program that can execute various types of control including the stapled-original detecting method as the medium detecting method according to the present invention, based on a combination of computer software programs already stored in a computer system. The computer software program to perform the function of the processing unit 61 can be stored in a recording medium that can be read by the computer. The computer system reads the computer software program stored in this recording medium, and executes the computer software program, thereby achieving various types of control including the stapled-original detecting method as the medium detecting method according to the present invention. The "computer system" includes an operating system (OS) and hardware such as peripheral units. Further, the storage unit 62 can be incorporated in the processing unit 61, or can be incorporated in another apparatus (for example, a database server).

The processing unit 61 includes a memory and a central processing unit (CPU) (both not depicted). In performing various types of control including the stapled-original detecting method as the medium detecting method, the processing unit 61 reads the computer software program into the memory built in the processing unit 61, and executes this program based on a preset procedure of various types of control including the stapled-original detecting method as the medium detecting method according to the present invention. The processing unit 61 performs the operation by suitably storing numerical values in the middle of the operation into the storage unit 62, and by taking out the stored numerical-values. The processing unit 61 can be realized by exclusive hardware instead of the computer software program.

In the control device 6 of the present embodiment, the processing unit 61 includes a speed-difference detecting unit 64 as a speed-deviation detecting unit, the stapled-original detecting unit 65 as a bound-medium detecting unit, and a feed stopping unit 66.

The speed-difference detecting unit 64 detects a speed difference (speed deviation) of the speed of sheets S detected by the first encoder 71 and the second encoder 72, respectively. The speed-difference detecting unit 64 counts a pulse number of an output pulse waveform indicated by pulse signals output by each of the first encoder 71 and the second encoder 72. The speed-difference detecting unit 64 calculates a pulse-number count value P1 corresponding to the output pulse waveform of the first encoder 71, and a pulse-number count value P2 corresponding to the output pulse waveform of the second encoder 72. The pulse-number count values P1 and P2 counted by the speed-difference detecting unit 64 are values corresponding to moving amounts of the sheets S.

The speed-difference detecting unit 64 according to the present embodiment calculates a speed V1 (P1/T) of each sheet S corresponding to the output pulse waveform of the first encoder 71, and a speed V2 (P2/T) of each sheet S corresponding to the output pulse waveform of the second encoder 72, and calculates a speed deviation based on the speed V1 and the speed V2. The speed deviation between the speed V1 and the speed V2 calculated by the speed-difference detecting unit 64 is a numerical value becoming a standard, that is, a value expressing a deviation of one speed from the other speed. In this case, the speed-difference detecting unit 64 calculates an absolute value of a difference between the speed V1 and the speed V2 as a deviation. That is, the speed-difference detecting unit 64 detects a speed difference $|V1-V2|$ based on the speed V1 and the speed V2.

The stapled-original detecting unit 65 can detect stapled originals based on the speeds detected by the first encoder 71 and the second encoder 72. The stapled-original detecting unit 65 according to the present embodiment detects stapled originals when the speed difference $|V1-V2|$ detected by the speed-difference detecting unit 64 is equal to or larger than a threshold value $\alpha$ set in advance.

Stapled sheets S having a corner thereof bound by the staple Sta, although they are properly set on the mounting surface 21, have the following problem. Although plural sheets S are bound by having each corner of each sheet S fixed to other ones by the staple Sta, each of the sheet S is fed and separated, and is rotated or deformed around the staple Sta as a supporting point. That is, as depicted in FIG. 3, when sheets S set on the mounting surface 21 are bound at a corner by the staple Sta or the like, the sheets S bound by the staple Sta are fed by the feeding unit 3 to the separating unit 4. When the top layer sheet S is separated from other sheets S by the separating unit 4, the top layer sheet S is rotated in the counterclockwise direction as indicated by the arrow in FIG. 3 around the staple St, because the sheets S are bound at the corner by the staple Sta.

In this case, out of the first encoder 71 and the second encoder 72, the second encoder 72 nearer to the rotation center of the sheet S, that is, nearer to the staple Sta, detects a speed of this portion of the sheet S. Therefore, a rotation radius of the sheet S at a portion at which the second encoder 72 detects the speed becomes smaller than a rotation radius of the sheet S at a portion at which the first encoder 71 detects the speed. Consequently, the speed of the sheet S detected by the second encoder 72 becomes lower (smaller) (or substantially zero) than the speed of the sheet S detected by the first encoder 71.

For example, as depicted in FIG. 4, during a period from when stapled originals are fed until when the downstream front end of sheets S reaches the separating unit 4 at a time t1, the speed V1 corresponding to the output pulse waveform by the first encoder 71 is substantially equal to the speed V2 corresponding to the output pulse waveform by the second encoder 72, and the speed difference |V1−V2| between the speed V1 and the speed V2 is relatively small. Meanwhile, during a period after the time t1 when the front end of the sheet S at the downstream reaches the separating unit 4, the separating unit 4 separates the top layer sheet S from other sheets S, and the top layer sheet S starts rotating around a portion of the staple Sta. Accordingly, one of the speed V1 corresponding to the output pulse waveform by the first encoder 71 and the speed V2 corresponding to the output pulse waveform by the second encoder 72 becomes smaller. In this case, the speed V1 relatively increases, and the other speed (that is, the speed V2) relatively decreases. Consequently, the speed difference |V1|V2| between the speed V1 and the speed V2 becomes relatively large.

Therefore, based on the speeds detected by the first encoder 71 and the second encoder 72, the stapled-original detecting unit 65 monitors rotation or deformation of a sheet generated when each sheet is separated from the stapled originals by the separating unit 4, and thus stapled originals are detected. That is, the stapled-original detecting unit 65 according to the present embodiment can detect stapled originals when the speed difference |V1−V2| detected by the speed-difference detecting unit 64 is equal to or larger than the threshold value α set in advance.

For example, when the stapled-original detecting unit 65 is configured to detect stapled originals when a difference between two moving amounts becomes equal to or larger than a predetermined value based on the moving amounts of a sheet S detected by the first encoder 71 and the second encoder 72, there is the following risk. Even when the sheets S are fed skewed to the feeding direction (cumulative skew) to such an extent that images can be read subsequently, a difference between the two moving amounts becomes large, and the sheets S are erroneously detected as stapled originals. That is, when stapled originals are detected by only monitoring a difference between the moving amounts of a sheet S by the first encoder 71 and the second encoder 72, it is difficult to differentiate between an inclination of a sheet S (cumulative skew) and a stapled original, and this has a risk of erroneously detecting sheets as stapled originals.

However, in the inclination (cumulative skew) of a sheet S which does not require a stopping of the feeding, the sheet S is fed by being slowly inclined to the feeding direction. Therefore, the speed difference |V1−V2| corresponding to the speeds V1 and V2 of the sheet S detected by the first encoder 71 and the second encoder 72 is smaller than a speed difference when the sheet S is rotating around a portion of the staple Sta. On the other hand, when the sheet S rotates (that is, the sheet S is inclined) around the portion of the staple Sta because of a stapled original, the sheet S rotates at a relatively higher speed than that when the sheet S is inclined. Therefore, the speed difference |V1−V2| corresponding to the speeds V1 and V2 of the sheet S detected by the first encoder 71 and the second encoder 72 becomes relatively large. Because the stapled-original detecting unit 65 according to the present embodiment can detect stapled originals based on the speeds V1 and V2 of the sheet S detected by the first encoder 71 and the second encoder 72, the stapled-original detecting unit 65 can detect rotation or deformation of a sheet S generated when a stapled original is fed when the speed difference |V1−V2| is equal to or larger than the threshold value α set in advance. Therefore, the stapled-original detecting unit 65 can accurately detect stapled originals by distinguishing between an inclination (cumulative skew) of the sheet S that does not require a stopping of the feeding and the stapled originals. That is, the sheet feeding apparatus 1 can suppress erroneous detection of an inclination (cumulative skew) of a sheet S not requiring stopping of the feeding as a stapled original.

It suffices that the threshold value α set to the speed difference |V1−V2| is suitably set by performing experiments or the like in advance, corresponding to layout sizes of the first encoder 71 and the second encoder 72 within a range in which rotation or deformation of a sheet S can be detected.

In the present embodiment, the encode disk 73 of the first encoder 71 and the encode disk 73 of the second encoder 72 are provided at the left side and the right side of the center C1 of the width direction, respectively. Therefore, a difference between a speed of a sheet S detected by the first encoder 71 and a speed of the sheet S detected by the second encoder 72 when the sheet S is rotated or deformed can be set larger than a speed difference when the two encode disks are set at the same side. Because the speed difference |V1−V2| when the sheet S is rotated or deformed can be set large, the stapled-original detecting unit 65 can detect stapled originals more accurately.

As described above, the speed-difference detecting unit 64 calculates the speed V1 (P1/T) of each sheet S corresponding to the output pulse waveform of the first encoder 71, and the speed V2 (P2/T) of each sheet S corresponding to the output pulse waveform of the second encoder 72, based on the count values P1 and P2 of each counted number of pulses and a detection time T. The speed-difference detecting unit 64 according to the present embodiment calculates the speed V1 (P1/T) and the speed V2 (P2/T) based on the pulse-number count values P1 and P2 calculated after each sheet S passes a predetermined point and based on the detection time T corresponding to a lapse of time after each sheet S passes a predetermined point. The speed-difference detecting unit 64 calculates the speed difference |V1−V2| based on the speeds V1 and V2 of each sheet S when the downstream front end of each sheet S moves in a predetermined region set in advance between the separating unit 4 and the carrying unit 5. In the present embodiment, the predetermined region set in advance between the separating unit 4 and the carrying unit 5 is set in a region from a point at which the top sensor 76 provided between the separating roller 41 of the separating unit 4 and the driving roller 51 of the carrying unit 5 can detect a sheet S to the driving roller 51. That is, the speed-difference detecting unit 64 calculates the speed difference |V1−V2| based on the speeds V1 and V2 of each sheet S detected during a period from a time (the time t1 in FIG. 4, for example) when the downstream front end of the sheet S reaches the point where the top sensor 76 can detect this front end when the top sensor 76 detects this front end until a time (a time t2 in FIG. 4, for example) when the downstream front end of the sheet S reaches the driving roller 51.

Therefore, in the example depicted in FIG. 4, the stapled-original detecting unit 65 detects stapled originals based on the speeds V1 and V2 of the sheet S during the predetermined period from the time t1 when the top sensor 76 detects the downstream front end of the sheet S until the time t2 when the front end reaches the driving roller 51. In other words, the stapled-original detecting unit 65 detects stapled originals by monitoring the speed difference |V1−V2| of the sheet S when the downstream front end of the sheet S moves in a predetermined region set in advance from the separating unit 4 to the carrying unit 5, that is, the region from the point where the top sensor 76 can detect the sheet S to the driving roller 51.

As a result, the stapled-original detecting unit 65 detects stapled originals based on the speed of the front end of the sheet S at the downstream that moves in a predetermined region set in advance from the separating unit 4 to the carrying unit 5, that is, the region from the point where the top sensor 76 can detect the sheet S to the driving roller 51. Therefore, the sheet feeding apparatus 1 can detect stapled originals based on the speeds V1 and V2 in the region in which rotation or deformation of a sheet S generated when the stapled originals are fed can be easily detected. Consequently, the stapled-original detecting unit 65 can effectively and securely detect stapled originals.

As described above, because the separating unit 4 separates the top layer sheet S from other sheets S of stapled originals, the top layer sheet S starts rotation or deformation around the stapled portion Sta. Therefore, the top layer sheet S of stapled originals tends to generate a behavior change such as rotation or deformation when the front end of the sheet S at the downstream reaches the region at the downstream of the separating unit 4. Accordingly, the stapled-original detecting unit 65 detects stapled originals when the speed difference |V1−V2| between the speeds V1 and V2 is equal to or larger than a threshold value α set in advance when the front end of the sheet S at the downstream reaches the region at the downstream of the separating unit 4 where the top layer sheet S of the stapled originals tends to generate a behavior change such as rotation or deformation. Consequently, the stapled-original detecting unit 65 can effectively and securely detect stapled originals.

As described above, the driving roller 51 of the carrying unit 5 is rotated at a higher rotation speed than rotation speeds of the paper feeding roller 31 and the separating roller 41. Therefore, the top layer sheet S of stapled originals that starts a behavior change of rotation or deformation by the separating unit 4 tends to promote the behavior change of the rotation or deformation of the sheet S when the top layer sheet is sandwiched between the driving roller 51 and the driven roller 52 of the carrying unit 5. Therefore, the stapled-original detecting unit 65 according to the present embodiment detects a stapled original when the speed difference |V1−V2| between the speeds V1 and V2 is equal to or larger than the threshold value α set in advance when the front end of the sheet S at the downstream is located in the region before the front end of the sheet S at the downstream reaches the carrying unit 5 that tends to promote the behavior change of rotation or deformation of the top layer sheet S of the stapled original, that is, in the region where the front end of the sheet S at the downstream is positioned in a predetermined region set in advance between the separating unit 4 and the carrying unit 5 (a region from the point where the top sensor 76 can detect the sheet S to the driving roller 51). Accordingly, the stapled-original detecting unit 65 can detect stapled originals before the front end of the sheet S at the downstream reaches the carrying unit 5 where the rotation or deformation of the sheet S tends to become suddenly large. Consequently, damages of the sheets S and the apparatus can be securely prevented.

When the stapled-original detecting unit 65 detects a stapled original, the feed stopping unit 66 stops the feeding unit 3 from feeding sheets S, thereby preventing the sheets S and the sheet feeding apparatus 1 from being damaged. In the present embodiment, when a stapled original is detected, the feed stopping unit 66 controls an retraction mechanism (not depicted) to retract the paper feeding roller 31, stops driving of other units, lowers the hopper 2 along the height direction, and thereafter, stops the driving of the paper feeding roller 31, thereby stopping the feeding of the sheets S.

Various types of control including the stapled-original detecting method by the sheet feeding apparatus 1 are explained in further detail with reference to a flowchart depicted in FIG. 5.

When sheets S are started to be fed and also when the driving motor 32 is started, the speed-difference detecting unit 64 all resets the pulse-number count value P1 corresponding to the output pulse waveform of the first encoder 71 and a pulse-number count value P2 corresponding to the output pulse waveform of the second encoder 72 as count results, and returns the pulse-number count values to an initial value 0 (S100). The pulse-number count values P1 and P2 are stored in the storage unit 62 of the control device 6 and the like.

The speed-difference detecting unit 64 counts pulse numbers of the output pulse waveforms indicated by the pulse signals output by the first encoder 71 and the second encoder 72, as the pulse-number count value P1 and the pulse-number count value P2, based on these pulse signals, as a speed detecting process. The speed-difference detecting unit 64 detects the speed V1 (P1/T) of each sheet S corresponding to the output pulse waveform of the first encoder 71 and the speed V2 (P2/T) of each sheet S corresponding to the output pulse waveform of the second encoder 72, based on the counted pulse-number count values P1 and P2 and the detection time T. After the top sensor 76 detects the front end of each sheet S at the downstream, the speed-difference detecting unit 64 detects the speeds V1 and V2 when the front end of each sheet S at the downstream is positioned in a predetermined region set in advance from the separating unit 4 to the carrying unit 5 (a region from the position where the top sensor 76 can detect the sheets S to the driving roller 51) (S102).

The speed-difference detecting unit 64 detects the speed difference |V1−V2| between the speeds V1 and V2 when the front end of each sheet S at the downstream moves in the predetermined region set in advance from the separating unit 4 to the carrying unit 5. The stapled-original detecting unit 65 monitors the speed difference |V1−V2| in this predetermined region (a region from the point where the top sensor 76 can detect the sheets S to the driving roller 51), and determines whether the speed difference |V1−V2| is equal to or larger than the threshold value α, as a stapled-original detecting process (a bound-medium detecting process) (S104).

When the stapled-original detecting unit 65 determines that the speed difference |V1−V2| is smaller than the threshold value α (NO at Step S104), the stapled-original detecting unit 65 determines that the sheet S currently being fed is not a sheet forming a stapled original. The control device 6 determines whether the sheet feeding apparatus 1 has finished feeding sheets S, based on detection result signals of various types of sensors such as an emptiness sensor and a paper sensor (S106). When the control device 6 determines that the sheet feeding apparatus 1 has finished feeding sheets S (YES at Step S106), the control device 6 finishes the control. When the control device 6 determines that the sheet feeding apparatus 1 has not finished feeding sheets S (NO at Step S106), the process returns to S100, and the process at and after S100 is repeatedly performed for the sheets S fed next.

When the stapled-original detecting unit 65 determines that the speed difference |V1−V2| is equal to or larger than the threshold value α (YES at Step S104), the stapled-original detecting unit 65 determines that the sheet S currently being fed is a sheet forming a stapled original (S108). The feed stopping unit 66 controls a retraction mechanism (not depicted) to retract the paper feeding roller 31, stops driving of other units, lowers the hopper 2 along the height direction, and thereafter, stops the driving of the paper feeding roller 31 (S110), and the control operation is finished.

The sheet feeding apparatus 1 according to the present embodiment explained above includes the feeding unit 3 capable of feeding sheets S, the first encoder 71 and the second encoder 72 capable of detecting speeds of the sheets S fed by the feeding unit 3, at plural positions along the width direction crossing the feeding direction of the sheets S, and the stapled-original detecting unit 65 capable of detecting stapled originals as sheets S having a part thereof bound with other sheets S, based on the speeds detected by the first encoder 71 and the second encoder 72.

The stapled-original detecting method (the medium detecting method) according to the present embodiment explained above includes the speed detecting process (S102) for detecting a speed of a medium at plural positions along the width direction crossing the feeding direction of fed sheets S, and the stapled-original detecting process (S104, S108) for detecting stapled originals as sheets S having a part thereof bound with other sheets S, based on the speeds at plural positions detected at the speed detecting process (S102).

Therefore, in the speed detecting process, the first encoder 71 and the second encoder 72 detect the speeds of the sheet S fed by the feeding unit 3, at plural positions along the width direction. In the stapled-original detecting process, the stapled-original detecting unit 65 detects stapled originals based on the speeds of the sheet S at plural positions, thereby detecting rotation or deformation of the sheet S generated at the time of feeding the stapled original, based on the speeds of the sheet S at plural positions. Accordingly, the stapled-original detecting unit 65 can accurately detect the stapled original.

The sheet feeding apparatus 1 according to the present embodiment includes the speed-difference detecting unit 64 that detects a speed difference detected by each of the first encoder 71 and the second encoder 72. The stapled-original detecting unit 65 detects stapled originals when the speed difference detected by the speed-difference detecting unit 64 is equal to or larger than the threshold value set in advance. Therefore, when the speed-difference detecting unit 64 detects a speed difference based on the speeds of the sheet S at plural positions, and also when this speed difference is equal to or larger than the threshold value set in advance, the stapled-original detecting unit 65 detects stapled originals. Accordingly, when the speed difference of the sheet S at plural positions becomes equal to or larger than the predetermined value, the stapled-original detecting unit 65 can detect rotation or deformation of the sheet S generated when a stapled original is fed, thereby detecting the stapled original.

The sheet feeding apparatus 1 includes the feed stopping unit 66 that stops the feeding of sheets S by the feeding unit 3 when the stapled-original detecting unit 65 detects a stapled original. Therefore, when the feed stopping unit 66 stops the feeding of a medium by the feeding unit 3 when the stapled-original detecting unit 65 detects the stapled original, damage of the sheets S and the sheet feeding apparatus 1 can be prevented while suppressing decrease of the operation efficiency.

The sheet feeding apparatus 1 further includes the hopper 2 on which sheets S are stacked, the separating unit 4 capable of separating each sheet S fed by the feeding unit 3 from the hopper 2, and the carrying unit 5 capable of carrying sheets S separated by the separating unit 4. The first encoder 71 and the second encoder 72 are provided at the upstream of the carrying unit 5 in the feeding direction. The stapled-original detecting unit 65 detects stapled originals based on the speeds of the sheet S when the front end of the sheet S at the downstream moves in a predetermined region set in advance from the separating unit 4 to the carrying unit 5. Therefore, when the stapled-original detecting unit 65 detects stapled originals based on the speeds of the sheet S when the front end of the sheet S at the downstream moves in a predetermined region set in advance from the separating unit 4 to the carrying unit 5, the stapled-original detecting unit 65 can detect stapled originals based on the speeds in the region where rotation or deformation of the sheet S generated when a stapled original is fed can be easily detected. Consequently, stapled originals can be detected effectively and securely.

In the sheet feeding apparatus 1, each of the first encoder 71 and the second encoder 72 has the encode disk 73 that is formed in a disk shape and can rotate in contact with each sheet S along the movement of the sheet S, and detects a speed of the sheet S based on the encode pattern 74 provided along a peripheral direction of the encode disk 73. Therefore, the first encoder 71 and the second encoder 72 rotate by having each encode disk 73 kept in contact with the sheet S along the movement of the sheet S, and detect the speed of the sheet S based on the encode pattern 74 provided in each encode disk 73. Consequently, the first encoder 71 and the second encoder 72 can detect the speed of the sheet S based on a movement of the sheet S relative to the feeding direction to each encode disk 73.

The sheet feeding apparatus and the medium detecting method according to the present invention are not limited to the embodiment described above, and can be variously modified within the scope of the appended claims. It has been explained that the sheet feeding apparatus and the medium detecting method are applied to an image reading apparatus such as an image scanner, a copying machine, a facsimile machine, and a character recognition apparatus. However, the present invention is not limited thereto, and the present invention can be also applied to a sheet feeding apparatus and a medium detecting method of various apparatuses. While it has been explained that the feeding unit is an uptaking-system paper feeding mechanism, a so-called downtaking-system paper feeding mechanism can be also applied.

While it has been explained that the two encoders of the first encoder 71 and the second encoder 72 are provided as a plural number of speed detecting units, three or more speed detecting units can be also provided. Further, while it has been explained that a so-called rotary encoder is used as a speed detecting unit, a detecting unit of other configurations can be also used when the speed detecting unit can detect a speed of a sheet along its movement.

It has been explained that each encoding disk 73 of the first encoder 71 and the second encoder 72 is provided at the upstream of the paper feeding roller 31 of the feeding unit 3 in the feeding direction. However, the present invention is not limited thereto, and each encoding disk 73 can be provided at other position, for example, between the paper feeding roller 31 and the separating roller 41. Further, it has been explained that the encoding disk 73 of the first encoder 71 and the encoding disk 73 of the second encoder 72 are provided along the width direction orthogonal to the feeding direction of the sheet S. Alternatively, these encoding disks 73 can be provided at deviated positions along the feeding direction so long as the encoding disks 73 are configured to be able to detect the speed of the sheet S at plural positions along the width direction of the sheet S.

It has been explained that the bound-medium detecting unit detects a bound medium based on speeds of a medium when the front end of the medium at the-downstream in the feeding direction moves in a predetermined region set in advance from the separating unit to the carrying unit. However, the present invention is not limited thereto, and the bound-medium detecting unit can be configured to be able to detect the bound medium based on a speed of the medium in the entire region.

According to the embodiments of the present invention, the bound medium can be accurately detected.

According to the embodiments of the present invention, damages on the medium and the apparatus can be prevented while suppressing decrease of the operation efficiency.

According to the embodiments of the present invention, the bound medium can be effectively and accurately detected.

According to the embodiments of the present invention, the medium moves to a feeding direction relative to each rotating body, and thus the speed of the medium can be detected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding apparatus comprising:

a feeding unit that feeds a sheet-like medium;

a plurality of speed detecting units that respectively detect a speed of the medium fed by the feeding unit, at a plurality of positions along a width direction of the medium orthogonal to a feeding direction of the medium; and a bound-medium detecting unit that detects the medium having a part thereof bound with another one of the medium, based on the speed detected respectively by the speed detecting units.

2. The sheet feeding apparatus according to claim 1, further comprising a speed-deviation detecting unit that detects a speed deviation of the speed detected respectively by the speed detecting units, wherein the bound-medium detecting unit detects the bound medium when the speed deviation is equal to or larger than a threshold value set in advance.

3. The sheet feeding apparatus according to claim 1, further comprising a feed stopping unit that stops feeding of the medium by the feeding unit, when the bound-medium detecting unit detects the bound medium.

4. The sheet feeding apparatus according to claim 1, further comprising:

a mounting unit on which the medium is mounted;

a separating unit that separates each of the medium fed by the feeding unit from the mounting unit; and a carrying unit that carries the medium separated by the separating unit, wherein the speed detecting units are provided at an upstream of the carrying unit in the feeding direction, and the bound-medium detecting unit detects the bound medium based on the speed of the medium when a front end of the medium at a downstream in the feeding direction moves in a predetermined region set in advance from the separating unit to the carrying unit.

5. The sheet feeding apparatus according to claim 1, wherein the speed detecting unit comprises a rotating member rotatable while being in contact with the medium along a movement of the medium and formed in a disk shape, and detects the speed based on an encode pattern provided along a peripheral direction of the rotating member.

6. A medium detecting method comprising:

detecting a speed of a sheet-like medium at a plurality of positions arranged along a width direction of the medium crossing a feeding direction of the fed medium; and detecting the medium having a part thereof bound with another one of the medium, based on the detected speed at the plurality of positions.

* * * * *